US007971319B2

(12) United States Patent
Becker et al.

(10) Patent No.: US 7,971,319 B2
(45) Date of Patent: Jul. 5, 2011

(54) HINGE FOR DOORS OR WINDOWS

(75) Inventors: Hugo Becker, Windeck-Stromberg (DE); Rudolf Wiemer, Windhagen (DE); Martin Frielingsdorf, Werkhausen (DE)

(73) Assignee: KL-Beschläge Karl Loggen GmbH, Eitorf (DE)

( * ) Notice: Subject to any disclaimer, the term of this patent is extended or adjusted under 35 U.S.C. 154(b) by 833 days.

(21) Appl. No.: 11/470,454

(22) Filed: Sep. 6, 2006

(65) Prior Publication Data

US 2007/0240283 A1 Oct. 18, 2007

(30) Foreign Application Priority Data

Sep. 7, 2005 (DE) ..... 20 2005 014 145 U

(51) Int. Cl.
*E05D 11/10* (2006.01)

(52) U.S. Cl. ..... 16/334; 16/245; 16/252

(58) Field of Classification Search ..... 16/334, 16/252, 382, 245, 297, 322, 338, 238, 246
See application file for complete search history.

(56) References Cited

U.S. PATENT DOCUMENTS

| | | | | |
|---|---|---|---|---|
| 2,362,923 | A | 12/1941 | Pardoe | |
| 2,427,384 | A | 9/1947 | Bushko | |
| 5,317,785 | A | 6/1994 | Kobayashi | |
| 5,367,745 | A * | 11/1994 | Roloff | 16/312 |
| 5,867,869 | A * | 2/1999 | Garrett et al. | 16/252 |
| 5,867,871 | A * | 2/1999 | Tasman | 16/335 |
| 6,065,187 | A | 5/2000 | Mischenko | |
| 6,070,294 | A * | 6/2000 | Perkins et al. | 16/252 |
| 6,481,055 | B2 * | 11/2002 | Cheng | 16/252 |
| 6,526,627 | B2 * | 3/2003 | Chiang | 16/284 |
| 6,560,821 | B2 * | 5/2003 | Miller et al. | 16/252 |
| 6,704,966 | B1 * | 3/2004 | Kao | 16/252 |
| 6,766,561 | B1 * | 7/2004 | Cheng | 16/235 |
| 7,188,390 | B2 * | 3/2007 | Cheng | 16/252 |
| 7,516,518 | B2 * | 4/2009 | Kiefer | 16/252 |
| 2005/0071952 | A1 * | 4/2005 | Chen | 16/252 |
| 2008/0083086 | A1 * | 4/2008 | Lin | 16/252 |

FOREIGN PATENT DOCUMENTS

| | | | |
|---|---|---|---|
| DE | 624610 | C1 | 1/1936 |
| DE | 647896 | C1 | 7/1937 |
| DE | 2136949 | A1 | 2/1973 |
| DE | 2418147 | A1 | 11/1975 |
| DE | 8333442 | U1 | 3/1984 |
| DE | 8426171 | U1 | 11/1984 |
| DE | 3531674 | A1 | 3/1986 |
| DE | 9004450 | U1 | 8/1990 |
| DE | 4112923 | A1 | 10/1991 |
| DE | 9114018 | U1 | 2/1992 |
| DE | 4311907 | A1 | 10/1993 |
| DE | 4239358 | A1 | 5/1994 |
| DE | 19623539 | A1 | 12/1997 |
| DE | 19631028 | A1 | 2/1998 |
| DE | 19700619 | A1 | 7/1998 |

(Continued)

*Primary Examiner* — William L. Miller
(74) *Attorney, Agent, or Firm* — Roger D. Emerson; Emerson Thomson Bennett

(57) ABSTRACT

A hinge for doors or windows may include two parts that are rotatable about a hinge axle. A catch device, arranged inside of the hinge, may have a catch element and a catch recess. The catch element may engage the catch recess in a catch position. Both the catch element and the catch recess may be arranged along the hinge axle.

20 Claims, 3 Drawing Sheets

FOREIGN PATENT DOCUMENTS

| | | | | |
|---|---|---|---|---|
| DE | 19920509 | A1 | | 11/1999 |
| DE | 20010009 | U1 | | 9/2000 |
| DE | 20117691 | U1 | | 2/2002 |
| DE | 20303036 | U1 | | 5/2003 |
| EP | 0565991 | A1 | | 10/1993 |
| EP | 0599255 | A1 | | 6/1994 |
| EP | 599255 | A1 | * | 6/1994 |
| FR | 2408711 | A1 | | 6/1979 |
| FR | 2408711 | A | * | 7/1979 |
| GB | 1341709 | | | 12/1973 |
| WO | WO 2004/085778 | A1 | | 10/2004 |
| WO | WO 2004085778 | A1 | * | 10/2004 |

* cited by examiner

Figure 1
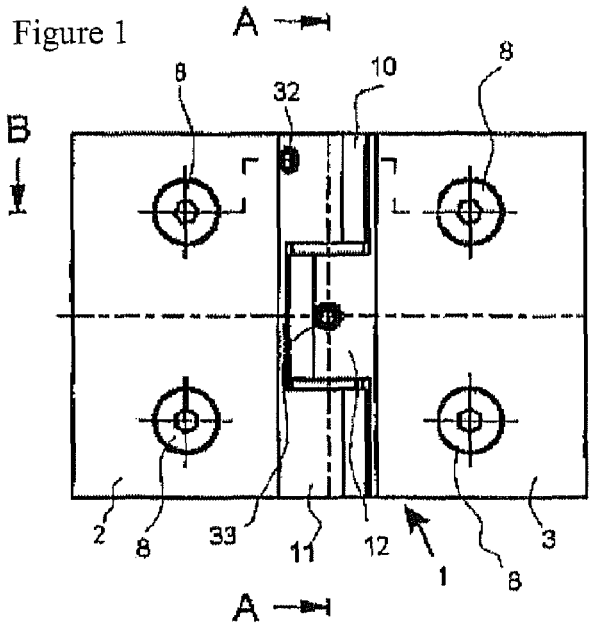
A-A
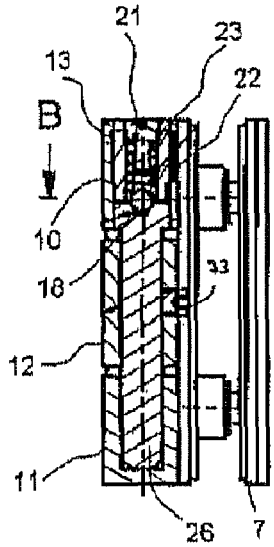
Figure 2
B-B
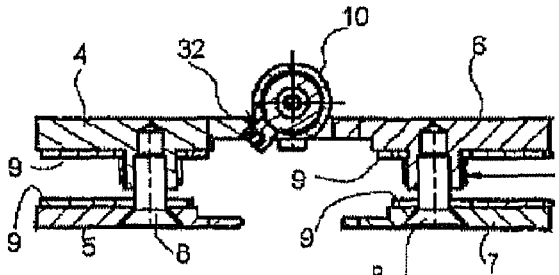
Figure 3

Figure 4
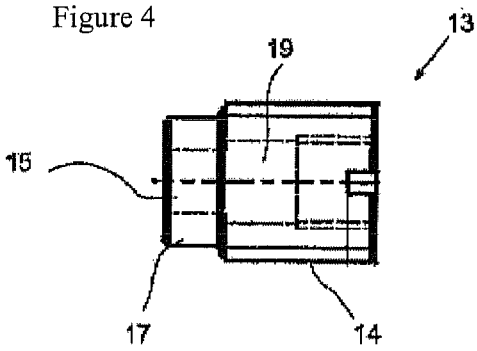
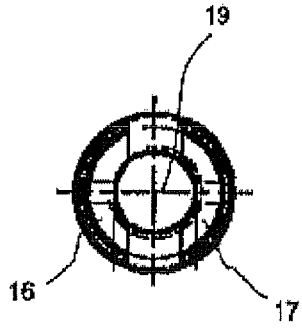
Figure 6
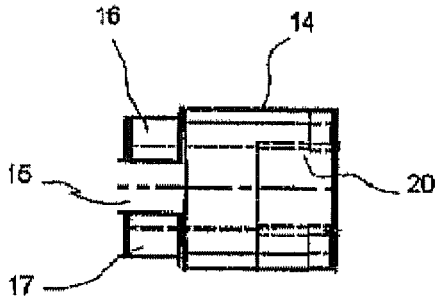
Figure 5
Figure 7
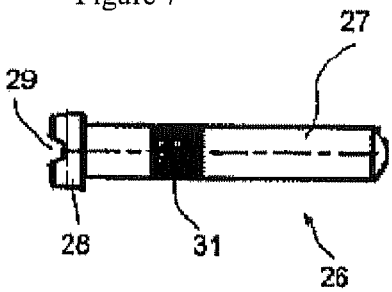
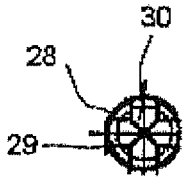
Figure 9
Figure 8
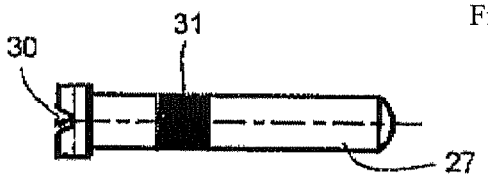

HINGE FOR DOORS OR WINDOWS

The invention concerns a hinge for doors or windows, especially for glass doors.

A hinge of this type is intended in particular for glass or acrylic glass doors without frames, in which the hinge is fastened directly on the glass pane or acrylic glass pane.

Hinges having catch devices are known for holding the hinge in certain positions. These hinges can be moved from these positions (generally opened and closed positions) only with considerable effort. For example, a hinge is known from the French patent application 2 408 711, in which a movable catch element that runs parallel to and offset from a hinge axle in a hinge part of the hinge acts on a guide body having an upward-directed control surface. The guide body is arranged stationary on this hinge part of the hinge so that the catch position of the hinge cannot vary.

A hinge having a catch device whose catch positions are adjustable is known from European patent application 0 599 255 A1. In this known hinge, a rotation body that has catch recesses is arranged around a hinge axle that connects two hinge parts with each other in a hinged manner around said hinge axle. A catch element that is supported in one of the two hinge parts engages in these catch recesses. The guide body is fixed by means of a clamping mechanism in the form of a clamping screw accessible from one side of the hinge and a pressure body so that the catch positions of the hinge are adjustable as required.

The hinge known from European patent application 0 599 255 A1, however, has the shortcoming that it is very expensive and cost-intensive. In addition, the adjustment possibility used in this hinge for the preferred positions (e.g., an opening position or a closed position) is unsuitable for small hinges because they have hardly any structural room for including such a catch device.

Another hinge in which the preferred positions can be adjusted is known from PCT application WO 2004/085778 A1. This known hinge has a hinge axle in which a catch element is supported by means of elastic elements in the radial direction, i.e., perpendicular to the axis of rotation of the hinge axle. In a catch position the catch element engages in a catch recess that is located in a sleeve located around the hinge axle. This adjusting device is also unsuitable for relatively small hinges because too much structural room is also required here. In addition, the known hinge can be mounted only with considerable effort, especially due to the catch element described.

The invention proposes to offer a hinge that is simple to build, is inexpensive and has an adjusting mechanism for the preferred positions that is also particularly well-suited for a relatively small hinge.

This problem is solved according to the present invention. Additional features of the invention are evident from the claims and the following description.

The invented hinge for doors or windows, especially for glass doors, has at least a first hinge part and at least a second hinge part. The first hinge part and the second hinge part are connected with each other in a hinged manner about a hinge axle that has an axis of rotation. A catch device that is located inside the hinge is also provided. The catch device involves at least one catch element and at least one catch recess. In a catch position the catch element engages in the catch recess. Accordingly, the catch position defines a preferred position in which the hinge is to be held (e.g., an opened or closed position). Both the catch element and the catch recess are located in the hinge axle in the inventive hinge.

The invention has the advantage that the catch device, with which the preferred positions (e.g., an opened or closed position) are adjustable, is located in the hinge axle itself. This also means that the catch element and/or the catch recess are themselves part of the hinge axle. Such a design is especially suited for small hinges because only a small structural space is required. The invention also facilitates inexpensive and simple production and assembly.

The catch element and the catch recess are preferably located along the axis of rotation in the hinge axle. The catch element or the catch recess is thus movable along the axis of rotation. It is alternatively provided that both the catch element and the catch recess are movable along the axis of rotation. It is valid here for the present application that the denotation "precisely on the axis of rotation" and "parallel and offset somewhat laterally to it" are also understood under the designation "along the axis of rotation." In particular, the invention depicts in one embodiment that the catch element engages in the catch recess along the axis of rotation in the catch position.

In a preferred embodiment of the invention the hinge axle has a first hinge axle element and a second hinge axle element separated from it. The hinge axle is thus formed by at least two hinge axle elements. Here, the first hinge axle element is preferably arranged on the first hinge part. However, the second hinge axle element is preferably arranged on the first hinge part and/or on the second hinge part. It has been demonstrated in practice that the arrangement of the second hinge axle element both on the first hinge part and also on the second hinge part is advantageous for stability reasons. Preferably, the first hinge part has a first pin receiver and the second hinge part has at least a second pin receiver. The first hinge axle element is arranged in the first pin receiver and the second hinge axle element is arranged in the second pin receiver. If the first hinge part has two first pin receivers, the first hinge axle element is located in one of these first pin receivers and the second hinge axle element is located in the other first pin receiver.

The first hinge axle element is preferably detachably arranged on the first hinge part in the inventive hinge. The second hinge axle element is detachably arranged on the second hinge part. A screw fastener is suited in particular for a detachable connection. For example, the first hinge axle element is fastened on the first hinge part with a set screw, preferably in one of the first pin receivers. However, the second hinge axle element is fastened with another set screw on the second hinge part, preferably in the second pin receiver. By detaching this connection, a preferred position (e.g., an opened or closed position) of the hinge can be adjusted by simple pivoting. The preferred position is fixed by subsequent seating of the set screw. Due to fastening the two hinge axle elements on the corresponding hinge parts, a movement of the first hinge part relative to the second hinge part will move the catch element out of the catch recess. By returning the first hinge part to the second hinge part, the catch element will again engage in the catch recess. The hinge will then hold in this position.

In another embodiment of the inventive hinge, the catch element is arranged on the first hinge axle element. The at least one catch recess is arranged in the second hinge axle element. Several catch recesses are preferably provided in order to fix both an opened and closed position of a door.

The first hinge axle element preferably has a guide element on which the catch element is arranged. The guide element is provided in particular so as to entrain the catch element in a movement of the first hinge part relative to the second hinge part, thus to be moved out of the catch recess.

It is also preferably provided that the first hinge axle element has at least one pressure element that is guided in the direction of the catch element. This pressure element acts on the catch element with a force. This force determines the resistance that must be overcome in a movement of the first hinge part relative to the second hinge part to get the catch element out of the catch recess. The force that must be applied to pivot the two hinge parts of the hinge is thus determined in this way.

In a particular embodiment the aforementioned pressure element is designed as a threaded element, especially as a screw. It is alternatively provided that the pressure element is designed as an elastic element that has a first end and a second end. The first end is supported against an adjusting element. The second end is supported against the catch element. This embodiment makes it possible for the catch element in the catch position to be always held in the catch recess. However, a pivoting movement of the two hinge parts relative to each other and thus a departure from the catch position is possible without problem because the position of the catch element is somewhat flexible due to the elastic arrangement. Furthermore, it is quite possible with this arrangement, due to the force that is adjustable with the adjusting element and that acts on the catch element through the elastic element, to determine the force required to bring the hinge out of the catch position.

In another embodiment of the invention the first hinge axle element has at least one guide means for guiding the first hinge axle element in the first hinge part. A continuously variable guide means, in particular a screw thread, is preferably provided, with which the first hinge axle element is arranged on the first hinge part, preferably in a first pin receiver.

The second hinge pin element also has advantageous designs. It is therefore provided in an embodiment of the invention that the second hinge axle element is designed as a hollow cylinder that has an opening that extends along the axis of rotation. The opening thus corresponds to the hollow space of the hollow cylinder. An elastic element, preferably a spring (e.g., a metal or plastic spring) that has a first element end and a second element end is arranged in the opening. The first element end is supported against a bottom of the second hinge axle element. However, the second element end is supported against a guide pin in which the at least one catch recess is arranged. In a particular embodiment the bottom of the second hinge axle element is designed as a bottom guide pin against which the first element end is supported. The bottom guide pin engages for a secure hold in a guide means that is arranged in the first hinge part, preferably in the aforementioned pin receiver. It is also advantageously provided that both the guide pin and the bottom guide pin have securing elements that engage in at least one guide opening in the second hinge axle element.

The invention is in the following on the basis of one embodiment shown in the figures:

FIG. 1 shows a schematic representation of a hinge.

FIG. 2 shows a cutaway representation of the hinge along the line A-A according to FIG. 1.

FIG. 3 shows a cutaway representation of the hinge along the line B-B according to FIG. 1.

FIG. 4 shows a side view of the first hinge axle element.

FIG. 5 shows a representation of the first hinge axle element rotated by 90° relative to the representation of FIG. 4.

FIG. 6 shows a plan view from the bottom of the first hinge axle element according to FIG. 4.

FIG. 7 shows a side view of a second hinge axle element.

FIG. 8 shows a representation of the second hinge axle element rotated by 90° relative to the representation of FIG. 7.

FIG. 9 shows a plan view on the second hinge axle element according to FIG. 7.

Figure 10:
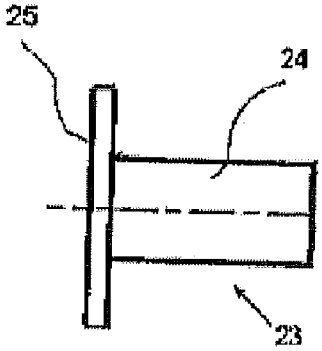
FIG. 10 shows a side view of a spring carrier.

FIGS. 1-11 show an embodiment example in the form of a hinge 1 that is designed as the so-called glass-glass hinge. It serves as the hinged connection of two glass modules, namely a glass wall and a glass door. It is expressly indicated here that the invention is not restricted to such hinges. Rather, the invention can also be used with other hinges, for example, on the so-called glass-wall-hinges in which a glass door is connected by hinges to a wall.

FIGS. 1-3 show the hinge 1, which has a first hinge part 2 and a second hinge part 3. The first hinge part 2 is provided with opposite clamping parts 4 and 5, between which a glass pane (not shown) is clamped by means of screws 8. In order not to damage the glass pane, the surfaces of the clamping parts 4 and 5 facing each other have pads 9 that are preferably made of rubber or plastic. The second hinge part 3 also has two clamping parts 6 and 7 that are arranged opposite each other. A glass door (not shown) is clamped by screws 8 between the clamping parts 6 and 7. In order not to damage the glass door, the surfaces of the clamping parts 6 and 7 facing each other also have pads 9 that advantageously are made of rubber or plastic.

The first hinge part 2 has two pin receivers 10 and 11, each located on an outer side of the hinge part 2. The hinge part 3 has a pin receiver 12 in the middle that engages in the intermediate space that is formed by the two pin receivers 10 and 11 of the hinge part 2. A multicomponent hinge axle, which is described more thoroughly below, is accommodated in the pin receivers 10, 11 and 12.

The hinge axle has a first hinge axle element 13 that is arranged in the pin receiver 10 of the first hinge part 2. The first hinge axle element 13 is shown in more detail in FIGS. 4-6. The first hinge axle element 13 is cylindrical and has a thread 14 on its outer periphery. The first hinge axle element 13 is arranged by means of the thread 14 in an opening of the pin receiver 10, which has a corresponding counter-thread.

On its bottom the first hinge axle element 13 has a seat 15, for receiving a catch element 18 (compare to FIG. 2), which is delimited by ridges 16 and 17. The catch element 18 is designed as a cylindrical body in this embodiment. In particular, a steel pin is suitable for this.

The first hinge axle element 13 is also provided with a central borehole in which a spring 22 (compare to FIG. 2) is arranged. The spring 22 bears against the catch element 18.

Figure 11:
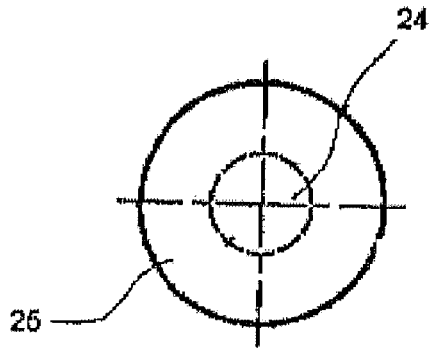
FIG. 11 shows a plan view of the spring carrier according to FIG. 10.

On its upper side the first hinge axle element 13 has an internal thread 20 in an opening that is provided for receiving a set screw 21 (compare to FIG. 2). A spring carrier 23, which is shown in detail in FIGS. 10 and 11, is located between the set screw 21 and the spring 22. The spring carrier 23 has a spring pin 24 that engages in one end of the spring 22. A plate element 25, which bears against the set screw 21, is arranged on the spring pin 24. The spring 22 is supported at one of its ends on the catch element 18 and at the other end on the spring carrier 23 and thus on the set screw 21.

The hinge pin also has a second hinge axle element 26, which is shown in FIGS. 2 and 7-9. The second hinge axle element 26 is provided with a cylindrical pin 27, on which is arranged a head 28. The head 28 has catch recesses 29 and 30 at right angles to each other, which have been formed V-shaped into the head 28. The pin 27 of the second hinge axle element 26 is received in the pin receiver 11 of the first hinge part 2 as well as the pin receiver 12 of the second hinge part 3. The pin receiver 11 is open only on one side and thus has no through hole. The pin 27 of the second hinge axle element 26 is thus securely seated in the pin receiver 11.

As can be understood from FIG. 2, the first and second hinge axle elements 13 and 26 are located along the axis of rotation of the hinge axle. The catch element 18 is also movably arranged along the axis of rotation. The catch element 18 is locked in place in the catch recess 29 or 30 due to a movement of the catch element 18 along the axis of rotation.

The first hinge axle element 13 can be fixed in the pin receiver 10 by means of a set screw 32 so that no relative movement can occur with regard to the pin receiver 10 (compare to FIG. 1). It is thus connected firmly (but also detachably) with the pin receiver 10. The same is true for the second hinge axle element 26. The latter is connected via a set screw 33 with the pin receiver 12 of the hinge part 3 firmly (but also detachably) (compare to FIGS. 1 and 2). To obtain a secure connection, the pin 27 of the second hinge axle element 26 has a corrugated surface 31 against which the set screw 33 is pressed.

It will now be described in the following how the preferred positions, namely an opened position and a closed position, are adjusted in the hinge 1 described. The two hinge parts 2 and 3 can be moved relative to each other by pivoting motion by loosening the set screw 32 and/or 33 without bringing the catch element 18 out of the catch recess 29 or 30. The parts of the hinge axle rotate accordingly. The hinge parts 2 and 3 are pivoted to the desired position in which the hinge 1 occupies the closed position. The catch element 18 engages in the catch recess 29 in this closed position. Because the catch recess 30 is essentially offset by 90° from the catch recess 29 and defines another catch position, an opened position of the hinge 1 is defined automatically by the position of the catch recess 30. The catch positions and thus the preferred positions are fixed by tightening the set screw 32 or 33 or tightening both set screws 32 and 33.

During operation, by pivoting the hinge part 3 around the hinge axle, that is by pivoting the glass door out of the closed position, the hinge axle element 13 will retain the catch element 18, which is located in the seat 15 delimited by the ridges 16 and 17. Accordingly, it is removed from the catch recess 29. As soon as the glass door has reached the opened position, the catch element 18 catches in the catch recess 30, which defines the opened position.

Spring 22 assures that the catch element 18 is always biased with a sufficient force into the catch recesses 29 and 30. This force is adjustable by means of the set screw 21. The more the set screw 21 is turned in the direction of the catch element 18, the more the spring 22 is compressed. The pressure or force on the catch element 18 is therefore also increased. It is thus possible to determine the force that must be applied to leave the catch positions. It is thus possible to adjust the opening and closing of a glass door to be more difficult or easier. It is also possible in this way to counteract wear on the spring 22 hereby.

The invention has the advantage that the catch device, with which the preferred positions (opened and closed positions) are adjustable, are arranged in the hinge axle itself. Such a design is particularly well suited for small hinges because only a little space is required. The invention also facilitates an inexpensive and simple production as well as assembly.

REFERENCE SYMBOL LIST

1 Hinge
2 First hinge part
3 Second hinge part
4 Clamping part
5 Clamping part
6 Clamping part
7 Clamping part
8 Clamping part
9 Seal
10 Pin receiver
11 Pin receiver
12 Pin receiver
13 First hinge axle element
14 Thread
15 Seat
16 Ridge
17 Ridge
18 Catch element
19 Seat
20 Internal thread
21 Set screw
22 Spring
23 Spring carrier
24 Pin
25 Plate element
26 Second hinge axle element
27 Pin
28 Head
29 Catch recess
30 Catch recess
31 Corrugated surface
32 Set screw
33 Set screw

The invention claimed is:

1. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the catch element is arranged on the first hinge axle element, and the catch recess is arranged on the second hinge axle element; and wherein the second hinge axle element is positioned on both the first and the second hinge parts.

2. The hinge according to claim 1, wherein the catch element and the catch recess are positioned in line with the axis of rotation of the hinge axle.

3. The hinge according to claim 1, wherein the catch element engages the catch recess in line with the axis of rotation of the hinge axle in the catch position.

4. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the catch element is arranged on the first hinge axle element, and the catch recess is arranged on the second hinge axle element; and wherein the first hinge part has a first pin receiver that receives the first hinge axle element, and the second hinge part has a second pin receiver that receives the second hinge axle element.

5. The hinge according to claim 4, wherein the first hinge part has two first pin receivers at least one of which receives the second hinge axle element, wherein the first hinge axle element is arranged in one of the first pin receivers and the second hinge axle element is arranged in the other of the first pin receivers.

6. The hinge according to claim 4, wherein:

the first pin receiver comprises a hollow cylinder that has an opening that extends along the axis of rotation of the hinge axle;

an elastic element is positioned within the opening and has a first end supported against an adjusting element and a second end supported against the catch element; and, the second hinge axle element comprises the catch recess.

7. The hinge according to claim 6, wherein the elastic element is a spring.

8. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the catch element is arranged on the first hinge axle element, and the catch recess is arranged on the second hinge axle element; and wherein the first hinge axle element is detachably arranged on the first hinge part, and wherein the second hinge axle element is detachably arranged on the second hinge part.

9. The hinge according to claim 8, wherein the first hinge axle element has a guide element in which the catch element is arranged.

10. The hinge according to claim 9, wherein the guide element includes a seat delimited by a pair of ridges.

11. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the catch element is arranged on the first hinge axle element, and the catch recess is arranged on the second hinge axle element;

wherein the first hinge axle element has at least one pressure element that is directed in the direction of the catch element; and wherein the pressure element is an elastic element having a first end supported against an adjusting element and a second end supported against the catch element.

12. The hinge according to claim 11, wherein the pressure element is directed in line with the axis of rotation of the first hinge axle element.

13. The hinge according to claim 11, wherein the pressure element comprises a thread.

14. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the catch element is arranged on the first hinge axle element, and the catch recess is arranged on the second hinge axle element;

wherein the first hinge axle element is positioned on the first hinge part; and wherein the first hinge axle element has guide means for guiding the first hinge axle element in the first hinge part.

15. The hinge according to claim 14, wherein the second hinge axle element is positioned on either the first or the second hinge part.

16. The hinge according to claim 14, wherein the guide means is continuously variable.

17. The hinge according to claim 16, wherein the guide means is a thread.

18. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the catch element is arranged on the first hinge axle element, and the catch recess is arranged on the second hinge axle element; and wherein the second hinge axle element comprises the catch recess, and the second hinge axle element comprises another catch recess.

19. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element detachably arranged on the first hinge part; and a second hinge axle element detachably arranged on the second hinge part, wherein the second hinge axle element is separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the first hinge axle element has a guide element in which the catch element is arranged; and wherein the guide element includes a seat delimited by a pair of ridges.

20. A hinge for doors or windows comprising:

a first hinge part and a second hinge part, the first hinge part and the second hinge part being connected with each other in a hinged manner about a hinge axle, which has an axis of rotation, wherein the hinge axle comprises:

a first hinge axle element; and a second hinge axle element separated from the first hinge axle element;

a catch device arranged in the hinge axle, which has a catch element and a catch recess, wherein the catch element engages in the catch recess in a catch position;

wherein both the catch element and the catch recess are arranged in the hinge axle;

wherein the first hinge part has a first pin receiver that receives the first hinge axle element;

wherein the second hinge part has a second pin receiver that receives the second hinge axle element;

wherein the first pin receiver comprises a hollow cylinder that has an opening that extends along the axis of rotation of the hinge axle;

wherein an elastic element is positioned within the opening and has a first end supported against an adjusting element and a second end supported against the catch element; and, wherein the second hinge axle element comprises the catch recess.

* * * * *